US008783435B2

(12) United States Patent
Matsuura et al.

(10) Patent No.: US 8,783,435 B2
(45) Date of Patent: Jul. 22, 2014

(54) BILL DISCRIMINATING AND COUNTING APPARATUS

(75) Inventors: Shinji Matsuura, Hyogo (JP); Toshio Numata, Hyogo (JP); Hajime Morino, Hyogo (JP); Shinji Matsui, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 1343 days.

(21) Appl. No.: 11/665,048

(22) PCT Filed: Oct. 12, 2004

(86) PCT No.: PCT/JP2004/015342

§ 371 (c)(1),
(2), (4) Date: Apr. 11, 2007

(87) PCT Pub. No.: WO2006/040834

PCT Pub. Date: Apr. 20, 2006

(65) Prior Publication Data

US 2009/0223777 A1 Sep. 10, 2009

(51) Int. Cl.

| | |
|---|---|
| ***G07F 7/04*** | (2006.01) |
| ***G07D 7/00*** | (2006.01) |
| ***G07D 7/12*** | (2006.01) |
| ***G07D 7/20*** | (2006.01) |
| ***G07D 11/00*** | (2006.01) |

(52) U.S. Cl.

CPC .. *G07F 7/04* (2013.01); *G07D 7/00* (2013.01); *G07D 7/12* (2013.01); *G07D 7/20* (2013.01); *G07D 11/0081* (2013.01); *G07D 11/0084* (2013.01); *B65H 2701/1912* (2013.01)

USPC ..... 194/206; 194/215

(58) Field of Classification Search

CPC ..... G07F 5/18; G07F 5/24; G07F 7/04; G07F 9/08; G07F 11/002; G07F 17/42; G07D 7/00; G07D 7/12; G07D 7/20; G07D 11/0018; G07D 11/0081; G07D 11/0084; B65H 2701/1912

USPC ..... 194/206, 207, 215; 209/534; 382/135

See application file for complete search history.

(56) References Cited

U.S. PATENT DOCUMENTS 4,428,501 A * 1/1984 Osako ..... 221/13
4,552,350 A * 11/1985 Nagy et al. ..... 271/3.19

(Continued)

FOREIGN PATENT DOCUMENTS

EP 1 160 739 A2 12/2001
GB 2 101 785 A 1/1983

(Continued)

OTHER PUBLICATIONS

Communication dated Jul. 6, 2010 issued by the European Patent Office in European Application No. 04773792.

*Primary Examiner* — Jeffrey Shapiro

(74) *Attorney, Agent, or Firm* — Renner, Kenner, Greive, Bobak, Taylor & Weber

(57) ABSTRACT

The present invention relates to a bill discriminating and counting apparatus having a function in which two operators can commonly operate the one apparatus. That is, two pairs of a process instruction button for instructing start/stop of a discriminating and counting process and an approval button for approving counting result are provided, two independent storage areas are provided in a storage area in which the counting result is stored, the counting result is stored in the corresponding storage area while each storage area is associated with the pair of the process instruction button and the approval button, and two operators can commonly use the one bill discriminating and counting apparatus by providing occupation switching means for switching an occupation state of the bill discriminating and counting apparatus and occupation state display means for displaying a current-occupation state.

4 Claims, 4 Drawing Sheets

(56) References Cited

U.S. PATENT DOCUMENTS

| | | | | |
|---|---|---|---|---|
| 4,577,763 | A * | 3/1986 | Placke et al. | 209/534 |
| 4,830,742 | A * | 5/1989 | Takesako | 209/534 |
| 4,905,840 | A * | 3/1990 | Yuge et al. | 209/534 |
| 4,962,919 | A * | 10/1990 | Azuchi et al. | 271/3.01 |
| 5,436,435 | A * | 7/1995 | McMillan | 235/379 |
| 5,628,258 | A * | 5/1997 | Zwahlen et al. | 109/45 |
| 6,637,647 | B2 * | 10/2003 | Katou et al. | 235/379 |
| 7,103,618 | B1 * | 9/2006 | Tramontano | 707/615 |
| 7,630,925 | B2 * | 12/2009 | Drummond et al. | 705/35 |
| 2003/0015395 | A1 * | 1/2003 | Hallowell et al. | 194/206 |

FOREIGN PATENT DOCUMENTS

| | | | |
|---|---|---|---|
| GB | 2 145 865 | A | 4/1985 |
| GB | 2 146 824 | A | 4/1985 |
| JP | 3-63797 | A | 3/1991 |
| JP | 7-118032 | B2 | 12/1995 |
| JP | 2003-296801 | A | 10/2003 |

* cited by examiner

BILL DISCRIMINATING AND COUNTING APPARATUS

TECHNICAL FIELD

The present invention relates to a bill discriminating and counting apparatus which discriminates a denomination of a bill received through a hopper while counting a total amount of the received bills or the number of bills in each denomination, particularly to the bill discriminating and counting apparatus having a function in which two operators can operate one apparatus.

BACKGROUND ART

There is a well known bill discriminating and counting apparatus, in which bills having mixed denominations are collectively received from a hopper, the bills are fed and carried one by one, the bills are counted while the denomination and authenticity of the bills are discriminated, and the total amount of the normal bill or the number of bills in each denomination is counted and displayed (for example, see Japanese Patent Application Laid-Open No. 2003-296801).

A structure and an operation of a conventional bill discriminating and counting apparatus will be described with reference to FIG. 1. FIG. 1 is a longitudinal cross-sectional view showing an internal structure of the conventional bill discriminating and counting apparatus.

A feeding roller 5 feeds the bill placed in a hopper 1 to a transport path of the bill discriminating and counting apparatus, and the bill is carried by plural carrying rollers 6.

During the bill carrying, the bill passes through detection sensors 7*a* and 7*b*, and a bill discriminating sensor 8 discriminates the denomination and authenticity. Then, the bill passes through a detection sensor 7*c*, and the bill is received between blades of a rotating impeller 9 when the bill is normal, and the bill is aligned and collected in a stacker 2. On the other hand, when the bill discriminating sensor judges that the bill is a forged bill, a solenoid 10 is operated to move a branching pawl 11 downward, and the bill is delivered to a rejection section 3.

The numeral 4 designates an operation and display section which performs various settings in performing the bill discriminating and counting process.

Conventionally, sometimes a bill credit processing apparatus used in a teller's window of a bank is installed and commonly used between two tellers, and the two tellers can operate the bill credit processing apparatus from both sides through a teller's machine which is of an upper-level apparatus.

In the conventional apparatus, because it is necessary that the bills sequentially put in the hoppers by the right and left tellers be counted and stored without mixing the bills, it is necessary that the apparatus be set in the state occupied by either of the tellers in each transaction from the beginning to the end.

However, when the apparatus is continuously set in the state occupied by one of the tellers until one transaction is ended, the other teller cannot perform the counting and storing operation with the apparatus, even if the counting and storing operation is interrupted by some reason. When the other teller uses the apparatus, because it is necessary that the interrupted process be reset to switch the apparatus to the state occupied by the other teller, the process initially performed by one of the tellers is wasted.

Therefore, the conventional apparatus has a problem on working efficiency. In consideration with these problems, there is proposed a bill credit processing apparatus having a function in which the two tellers can use the one apparatus (for example, see Japanese Patent Application Publication No. 7-118032).

The bill credit processing apparatus disclosed in Japanese Patent Application Publication No. 7-118032 is specialized in the apparatus which is commonly used by the bank tellers, the bill credit processing apparatus is located under a teller's machine occupied by each teller, and the occupation state is switched by the teller's machine.

However, in the conventional bill discriminating and counting apparatus, the occupation is not determined by an instruction from the upper-level apparatus such as the teller's machine, and originally the one teller uses the one bill discriminating and counting apparatus from a commonsense standpoint. Therefore, design is not made such that the two operators can commonly use the one apparatus. Accordingly, in a store or a financial institution in which the bill discriminating and counting apparatus is used, it is necessary that the number of bill discriminating and counting apparatus be required as many operators as there are, which results in a problem from the standpoint of capital investment.

DISCLOSURE OF THE INVENTION

In view of the foregoing, an object of the invention is to provide a bill discriminating and counting apparatus in which the two operators can commonly use the one apparatus, and thereby the efficiency in the bill discriminating and counting work is enhanced, and total cost of introducing the apparatus is decreased.

MEANS FOR SOLVING THE PROBLEMS

The present invention relates to a bill discriminating and counting apparatus having a function in which two operators can commonly operate one apparatus. In order to achieve the above object, a bill discriminating and counting apparatus according to an aspect of the invention includes a hopper which receives bills to be processed; a feeding and carrying section which feeds the bills received by said hopper one by one to a transport path and carries the bill; a discriminating and counting section which is provided on a downstream side of said feeding and carrying section, said discriminating and counting section discriminating denominations of the carried bills and counting the bills; and a stacker which is provided on the downstream side of said discriminating and counting section, said stacker collecting the bills in which normality is confirmed, wherein two pairs of a process instruction button for instructing start/stop of a discriminating and counting process and an approval button for approving counting result are provided, two independent storage areas are provided in a storage area in which the counting result is stored, said counting result is stored in the corresponding storage area while said each storage area is associated with the pair of the process instruction button and the approval button, and occupation switching means for switching an occupation state of said bill discriminating and counting apparatus and occupation state display means for displaying the current occupation state are provided.

In the bill discriminating and counting apparatus according to the aspect of the invention, preferably the occupation state of the bill discriminating and counting apparatus is switched by pressing said process instruction button.

BEST MODE FOR CARRYING OUT THE INVENTION

The present invention relates to a bill discriminating and counting apparatus having a function in which two operators can commonly operate one apparatus. That is, two pairs of a process instruction button for instructing start/stop of a discriminating and counting process and an approval button for approving counting result are provided, two independent storage areas are provided in a storage area in which the counting result is stored, the counting result is stored in the corresponding storage area while each storage area is associated with the pair of the process instruction button and the approval button, and two operators can commonly use the one bill discriminating and counting apparatus by providing occupation switching means for switching an occupation state of the bill discriminating and counting apparatus and occupation state display means for displaying a current occupation state.

The bill discriminating and counting apparatus according to the invention will be described in detail with reference to the drawings.

Figure 1:
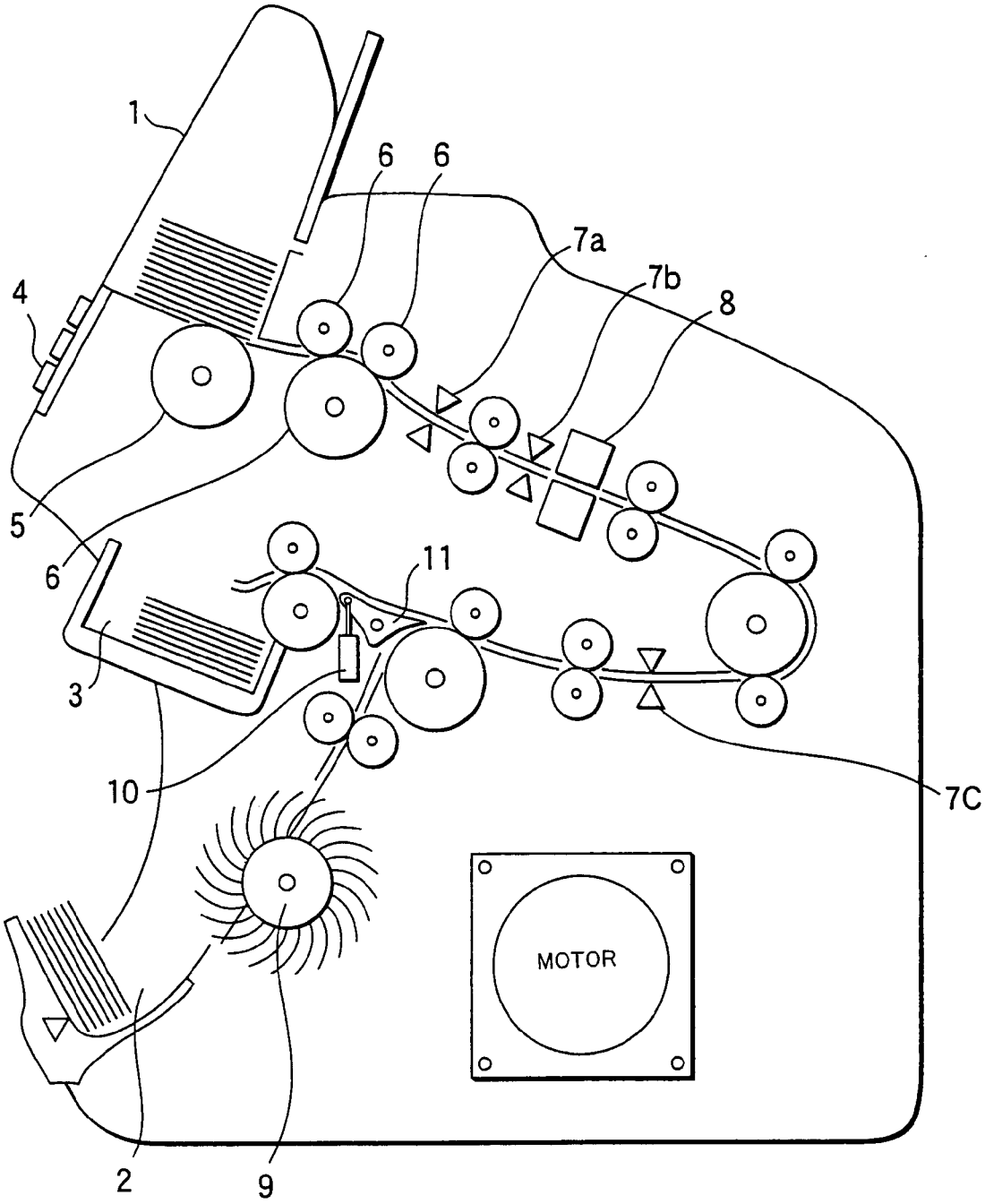
FIG. 1 shows an internal structure of a conventional bill discriminating and counting apparatus.
Figure 2:
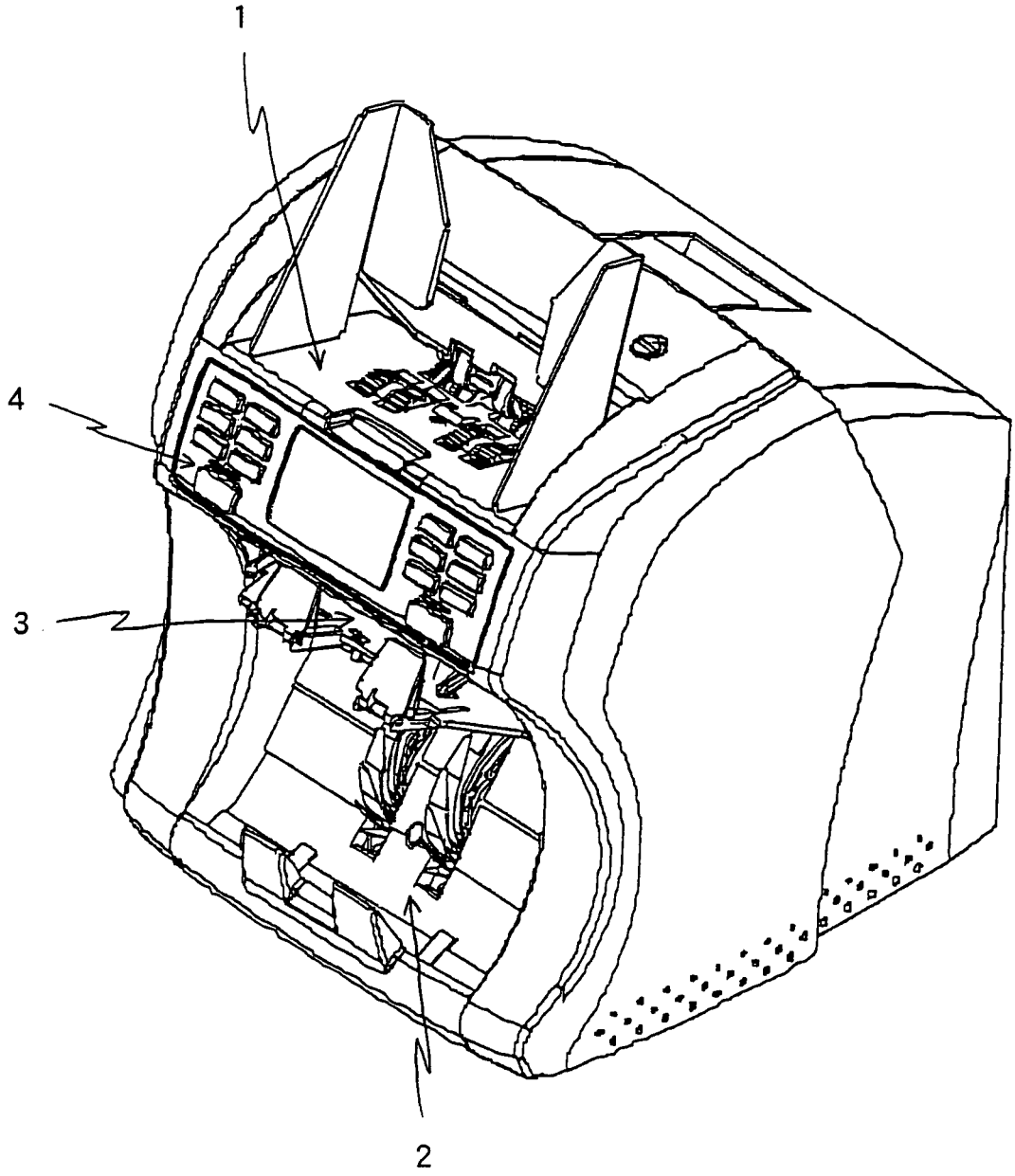
FIG. 2 is a perspective view showing an appearance of a bill discriminating and counting apparatus according to the invention.

FIG. 2 is a perspective view showing an appearance of the bill discriminating and counting apparatus according to the invention. The bills put in from the hopper 1 are discriminated and counted by the bill discriminating and counting apparatus, and the bills are aligned and collected in the stacker 2. The bill in which the process cannot be performed due to the forged bill or dirt is delivered to the rejection section 3. The operation and display section 4 includes various operation buttons, and two users can commonly use the one bill discriminating and counting apparatus by operating the operation and display section 4.

Figure 3:
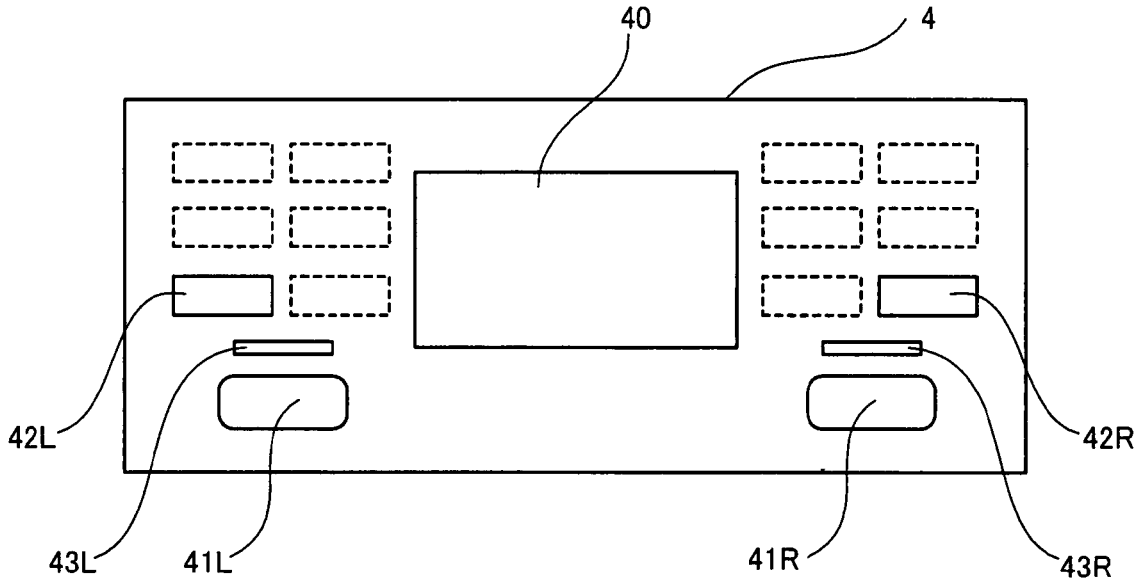
FIG. 3 shows an operation and display section of the bill discriminating and counting apparatus according to an embodiment of the invention.

FIG. 3 shows the operation and display section 4 of the bill discriminating and counting apparatus according to an embodiment of the invention. A liquid crystal panel 40, which performs various displays, is located in the center of the operation and display section 4. Each of pairs of START/STOP keys 41, ACCEPT keys 42, and occupation display LEDs 43 is arranged while divided on the right and left sides of the liquid crystal panel 40. Although other keys shown by dotted lines are used to set various operations, description is neglected because these keys have no immediate relationship to the invention.

Thus, the keys (41 and 42) having the same functions are arranged while divided on the right and left sides, the two operators can easily operate the bill discriminating and counting apparatus when the bill discriminating and counting apparatus is placed between the two operators. The occupation display LEDs 43L and 43R display which operator currently occupies the bill discriminating and counting apparatus.

Figure 4:
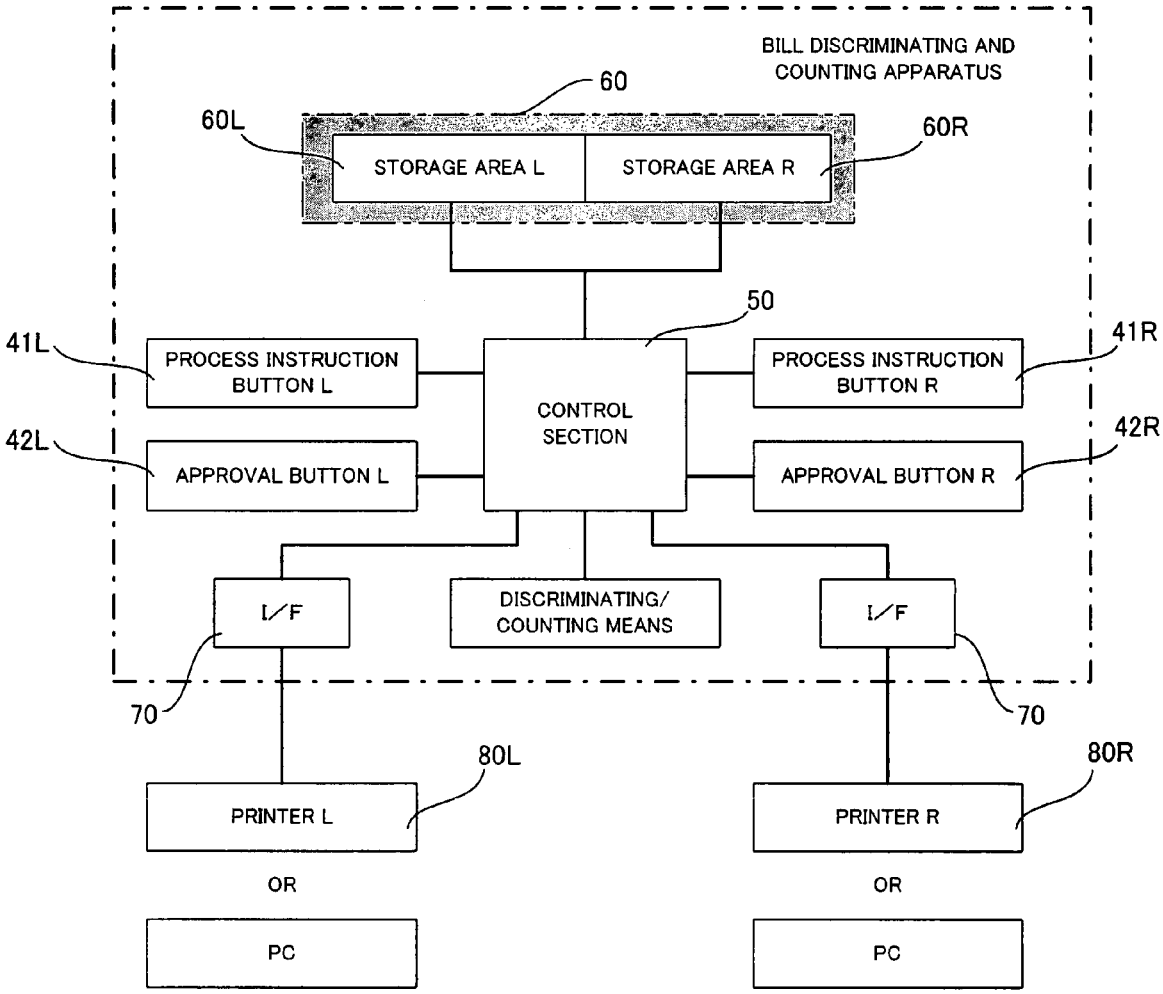
FIG. 4 shows a part of a control block diagram of the bill discriminating and counting apparatus according to the invention.

FIG. 4 shows a part of a control block diagram of the bill discriminating and counting apparatus according to the invention.

A process instruction button L (41L) and a process instruction button R (41R) correspond to the START/STOP key 41 of FIG. 3, and an approval button L (42L) and an approval button R (42R) correspond to the ACCEPT key 42 of FIG. 3. A storage area L (60L) and a storage area R (60R) are storage areas in which each of the sum of counting result is stored when each of the R and L-side operators performs the discriminating and counting process. A control section 50 writes the counting result in the storage area L (60L) and storage area R (60R). Thus, because the storage area is divided into the L and R storage areas, the counting results have no influence on each other.

When the approval button 42L or 42R is pressed, the outputs of the counting results (total amounts) stored in the storage areas 60L and 60R can be outputted to external printers 80L and 80R, or personal computers (PC) respectively. The bill discriminating and counting apparatus is connected to the printers or PCs through interfaces (I/F) 70.

In the case where the bill discriminating and counting apparatus has a setting (double-headed setting) in which the two operators can commonly use the apparatus, for example, the R-side operator occupies the apparatus when the power is turned on. That is, the R-side occupation display LED 43R is lit. When the L-side operator uses the apparatus, the L-side operator can press the process instruction button L (41L) during a standby time to switch the apparatus to the L-side occupation. In this case, the L-side occupation display LED 43L is lit.

In the bill discriminating and counting apparatus according to the invention, the pairs of the START/STOP keys 41 and the ACCEPT keys 42 are arranged on the right and left sides such that the two operators can commonly use the one apparatus. Accordingly, in the case where the apparatus has the setting (single-headed setting) in which either of the operators singularly uses the apparatus, because both the right and left keys become simultaneously enabled, the operator can operates the keys according to a dominant arm of the operator, which further improves the usability.

TABLE 1

| Mode | Terminal I/F | Double-headed Setting | Printer setting |
|---|---|---|---|
| 1 | Off-line | Single-headed(OFF) | OFF |
| 2 | | | ON(one printer) |
| 3 | | Double headed(ON) | OFF |
| 4 | | | ON(one printer) |
| 5 | | | ON(two printer) |
| 6 | Online(Only R-side) | Double headed(ON) | OFF |
| 7 | | | ON(L-side only) |
| 8 | Online | Double headed(ON) | OFF |
| 9 | | Single-headed(OFF) | OFF |

Table 1 shows patterns of operation modes of the bill discriminating and counting apparatus according to the invention. The modes will be described below with reference to Table 1. In Table 1, online means that the computer (including PC) is connected to I/F 70 of FIG. 4, off-line means that the computer is not connected to I/F 70, printer setting OFF means that the printer is not connected.

(1) Off-Line, Single-Headed Setting, and Printer Setting Off

Both the L-side and R-side keys are enabled, and the total amount is stored in the R-side storage area. Both the occupation display LEDs are lit.

(2) Off-Line, Single-Headed Setting, and One Connected Printer (Connection is Automatically Detected)

Both the L-side and R-side keys are enabled, and the total amount is stored in the R-side storage area. Both the occupation display LEDs are lit. The counting result is printed when either of the ACCEPT keys 42 is pressed.

(3) Off-Line, Double-Headed Setting, and Printer Setting Off

In a default state, the R-side LED is lit while the L-side LED is turned off. When the L-side START/STOP key 41L is pressed during the standby time, the apparatus is switched to the L-side occupation, and the R-side LED is turned off while the L-side LED is lit. The counting results are separately stored in L-side and R-side storage areas.

(4) Off-Line, Double-Headed Setting, and One Connected Printer (Connection is Automatically Detected)

Basically, as with the mode (3), when the ACCEPT key 42L or 42R is pressed, the counting result is printed by one printer.

(5) Off-Line, Double-Headed Setting, and Two Connected Printers

Basically, the mode (5) is similar to the mode (3). When the ACCEPT key 42L or 42R is pressed, the counting results is printed by the printers respectively.

(6) Online (Only R-Side), Double-Headed Setting, and Printer Setting Off

In the default state, the R-side LED blinks while the L-side LED is turned off. When the L-side START/STOP key 41L is pressed for at least two seconds during the standby time, the apparatus is switched to the L-side occupation, and the R-side LED is turned off while the L-side LED is lit. The counting results are separately stored in the L-side and R-side storage areas. When the R-side START/STOP key 41L is pressed for at least two seconds during the standby time, or when the apparatus is switched to remote control occupation, the apparatus is switched to the R-side occupation, and the R-side is returned to online setting.

(7) Online (Only R-Side), Double-Headed Setting, and Printer Setting on (Only L-Side)

In the default state, the R-side LED blinks while the L-side LED is turned off. When the L-side START/STOP key 41L is pressed for at least two seconds during the standby time, the apparatus is switched to the L-side occupation, and the R-side LED is turned off while the L-side LED is lit. The counting results are separately stored in the L-side and R-side storage areas. When the ACCEPT key 42L is pressed, the counting result is printed by the L-side printer. When the R-side START/STOP key 41L is pressed for at least two seconds during the standby time, or when the apparatus is switched to remote control occupation by PC, the apparatus is switched to the R-side occupation, and the R-side is returned to the online setting.

(8) Online, Double-Headed Setting, and Printer Setting Off

In the default state, the R-side LED blinks while the L-side LED is turned off. When the L-side START/STOP key 41L is pressed during the standby time, or when the apparatus is switched to remote control occupation by PC, the apparatus is switched to the L-side occupation, and the R-side LED is turned off while the L-side LED blinks. The counting results are separately stored in the L-side and R-side storage areas.

(9) Online, Single-Headed Setting, and Printer Setting Off

Both the L-side and R-side keys are disabled, and the remote control is performed by the connected PC. The total amount is stored in the R-side storage area. Both the occupation display LEDs blink.

As described above, in the bill discriminating and counting apparatus according to the invention, the two process instruction buttons are provided, and the storage areas are provided in association with the process instruction buttons respectively, so that the processing result can be retained in each operator. Therefore, although the two operators cannot simultaneously operate the apparatus, apparently the operators can use the apparatus as the two apparatus, which results in the excellent cost performance.

Although the invention is described based on the embodiment, the invention is not limited to the embodiment. The technical features of the invention are described only in claims of the invention, and various changes and modifications could be made without limitation.

The invention claimed is:

1. A bill discriminating and counting apparatus comprising:

a hopper which receives bills to be processed;

a feeding and carrying section which feeds the bills received by said hopper one by one to a transport path and carries the bill;

a discriminating and counting section which discriminates denominations of the carried bills and counts the bills;

a stacker which collects the bills in which normality is confirmed;

two independent process instruction buttons, each capable of starting and stopping the discriminating and counting section;

two independent approval buttons, each capable of approving counting results from the discriminating and counting section; and a storage which is divided into two independent storage areas for storing the counting results;

wherein the counting results are stored in a corresponding storage area of the two independent storage areas and each of the two independent storage areas is associated with a corresponding process instruction button of the two independent process instruction buttons and a corresponding approval button of the two independent approval buttons, wherein the counting results of a first process instruction button of the two independent process instruction buttons is stored in a first independent storage area of the two independent storage areas independent of the counting results of a second process instruction button of the two independent process instruction buttons which is stored in a second independent storage area of the two independent storage areas, wherein a first process instruction button of the two independent process instruction buttons corresponds to a first operator and a second process instruction button of the two independent process instruction buttons corresponds to a second operator, and wherein in a default operation state, an LED corresponding to the first process instruction button is lit, and when the second process instruction button is pressed, an operation state of the bill discriminating and counting apparatus is switched to correspond to the second process instruction button and an LED corresponding to the second process instruction button is lit.

2. The bill discriminating and counting apparatus according to claim 1, wherein an operation state of said bill discriminating and counting apparatus is switched by pressing one of said two independent process instruction buttons.

3. The bill discriminating and counting apparatus according to claim 2, wherein a current operation state is displayed by a display unit.

4. The bill discriminating and counting apparatus according to claim 1, wherein a first approval button of the two independent approval buttons corresponds to the first operator and the second approval button of the two independent approval buttons corresponds to the second operator.

* * * * *